US009178276B1

(12) United States Patent
Jennings

(10) Patent No.: US 9,178,276 B1
(45) Date of Patent: Nov. 3, 2015

(54) WIDELY VARIED RECONFIGURABLE APERTURE ANTENNA SYSTEM UTILIZING ULTRA-FAST TRANSITIONED APERTURE MATERIAL

(71) Applicant: William C. Jennings, Iowa City, IA (US)

(72) Inventor: William C. Jennings, Iowa City, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 262 days.

(21) Appl. No.: 13/768,622

(22) Filed: Feb. 15, 2013

(51) Int. Cl.
*H01Q 1/24* (2006.01)
*H01Q 3/00* (2006.01)
*H01Q 3/01* (2006.01)

(52) U.S. Cl.
CPC ... *H01Q 3/00* (2013.01); *H01Q 3/01* (2013.01)

(58) Field of Classification Search
USPC ..... 343/700 MS, 724
See application file for complete search history.

(56) References Cited

U.S. PATENT DOCUMENTS 5,105,200 A * 4/1992 Koepf ..... 343/700 MS
5,201,065 A * 4/1993 Niehenke ..... 455/83
5,485,170 A * 1/1996 McCarrick ..... 343/895
5,589,845 A * 12/1996 Yandrofski et al. ..... 343/909
2002/0126048 A1* 9/2002 Zhu et al. ..... 343/700 MS
2007/0052592 A1* 3/2007 Purden et al. ..... 343/700 MS

OTHER PUBLICATIONS

Carl Merrigan, Victor Diez-Blanco, Richard F. Haglund, Jr.; Laser Switching of Thin Films of Vanadium Dioxide, http://www.vanderbilt.edu/vinse/reu/sites/reu.com/files/pt/posters/Carl%20Merrigan%20Student%20Poster.pdf, Print date Feb. 15, 2013, 1 page.

E. Sovero, Fast Thin Film Vanadium Dioxide Microwave Switches, Gallium Arsenide Integrated Circuit (GaAs IC) Symposium, Technical Digest, Oct. 7-10, 1990, pp. 101-103.

* cited by examiner

*Primary Examiner* — Tho G Phan
(74) *Attorney, Agent, or Firm* — Angel N. Gerdzhikov; Donna P. Suchy; Daniel M. Barbieri

(57) ABSTRACT

A reconfigurable antenna system is provided. The reconfigurable antenna system includes a substrate and a vanadium dioxide film deposited on a surface of the substrate. The vanadium dioxide film is configured to transition from a first phase to a second phase in response to a stimulant, such as coherent laser light. The reconfigurable antenna system also includes a transition source such as an optical engine configured to stimulate the vanadium dioxide film from the first phase to the second phase. The reconfigurable antenna system also includes a microcontroller in communication with the transition source. The microcontroller is configured to change a configuration of the reconfigurable antenna system by providing the transition source to the film according to a predetermined antenna image, the configuration of the reconfigurable antenna system including at least one of the radiation polarization, an operating frequency, and radiation pattern of the reconfigurable antenna system.

18 Claims, 6 Drawing Sheets

WIDELY VARIED RECONFIGURABLE APERTURE ANTENNA SYSTEM UTILIZING ULTRA-FAST TRANSITIONED APERTURE MATERIAL

TECHNICAL FIELD

The present disclosure generally relates to the field of reconfigurable antenna systems and more particularly to a reconfigurable aperture antenna based on coherent radiation affecting ultra-fast phase transition in the aperture material.

BACKGROUND

Existing technological approaches to reconfiguring antennas in impedance bandwidth, field polarization, operating frequency and radiation pattern may be limited by the underlying structure and geometry of the reconfigurable antenna system. For example, the antenna may be designed to provide several different configurations, but the scope of each configuration and the number of configurations that the antenna may adopt is inherently limited by the system's geometry. The limitations on the reconfigurable antenna system configuration will limit the uses and scope of communication options available to the particular reconfigurable antenna system.

Therefore, there exists a need for reconfigurable antenna systems offering greater configuration and reconfiguration flexibility than existing systems.

SUMMARY

The present disclosure is directed to a reconfigurable antenna system including a vanadium dioxide film deposited on a substrate. The vanadium dioxide film is able to transition from a first phase to a second phase in response to 532 nm laser light. The transition takes place at a rate of less than 100 femtoseconds. The reconfigurable antenna system also includes a picoprojector which projects the 532 nm laser light to stimulate at least a portion of the vanadium dioxide film from the first phase to the second phase. The reconfigurable antenna system also includes a microcontroller in communication with the picoprojector. The microcontroller is configured to change the configuration (including the radiation polarization, operating frequency, and radiation pattern) of the antenna by providing the 532 nm laser light from the picoprojector to the vanadium dioxide film according to a predetermined antenna image. Using the system, the radiation polarization, operating frequency, and radiation pattern of the antenna may be selectively controlled and varied.

The present disclosure is also directed to a reconfigurable antenna system including a film deposited on a surface of a substrate. The film is capable of transitioning from a first phase to a second phase in response to a stimulant. The reconfigurable antenna system also includes a transition source which stimulates at least a portion of the film to transition it from the first phase to the second phase. The reconfigurable antenna system also includes a controller in communication with the transition source. The controller changes any one of the radiation polarization, operating frequency, and radiation pattern of the reconfigurable antenna system by providing the transition source to at least a portion of the film according to a predetermined antenna image.

The present disclosure is also directed to a method for configuring an antenna. The method includes the step of receiving a predetermined antenna image for configuring the antenna. The method also includes the step of applying a stimulant to a film deposited on a substrate of the antenna according to the predetermined antenna image. A further step of the method includes transitioning the film from a first phase to a second phase according to the predetermined antenna image.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Figure 1A:
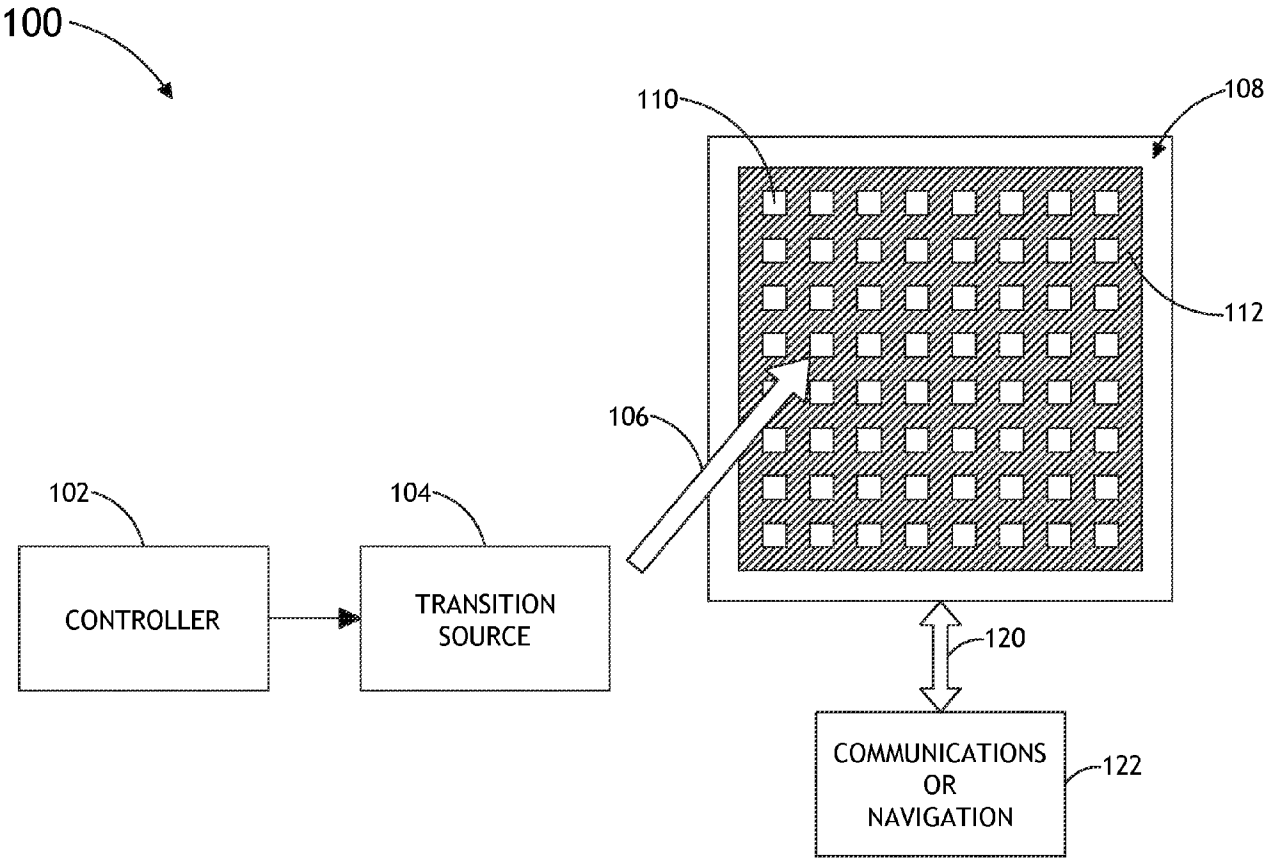
FIG. 1A is a diagram of a reconfigurable antenna system.

Existing technological approaches to reconfiguring antennas in impedance bandwidth, field polarization, operating frequency and radiation pattern utilize wide and varied mechanisms.

An example of a reconfiguration mechanism may include a Microelectromechanical System (MEMS). A MEMS device may switch or vary parasitic reactance to shift the operating frequency of the antenna within a limited frequency bandwidth. A MEMS device may also be used to vary the interconnection of elements of an antenna array thereby modifying the overall radiation pattern, polarity and or gain of the reconfigurable antenna. Existing reconfigurable antenna systems incorporating MEMS technology require control circuitry and voltages which increase the antenna design complexity, require additional space to implement, may decrease overall antenna performance and increase the cost of the antenna system design. Reconfigurable antennas using MEMS to switch antenna elements, parasitic elements or transmission lines, provide limited antenna reconfiguration.

Various other electrical and electromechanical technologies such as voltage variable capacitors, piezoelectric actuators, and PIN diodes may be used as mechanisms for reconfiguring antennas. Reconfigurable antennas based on these mechanisms provide limited antenna reconfiguration and suffer similar shortcomings as MEMS reconfigurable antennas.

The present disclosure is directed to a flexible antenna which may be ultra-fast reconfigured into a range of antenna configurations such as beam steering arrays of dipole antennas, crossed-dipole antennas, linear and circularly polarized microstrip antennas, slot antennas, modulated arm width, hybrid, circular or square spiral antennas, fractal antennas, genetic algorithm antennas, log periodic or Yagi Uda antennas, sinuous antennas or tapered slot Vivaldi antennas resulting in near instantaneous diversity in radiation polarization, operating frequency, bandwidth, radiation pattern and antenna structure or architecture.

The reconfigurable antenna system may include a vanadium dioxide film on sapphire substrate that is ultra-fast reconfigurable using a microcontroller generated laser image projected onto the vanadium dioxide film. The laser is capable of phase transitioning the vanadium dioxide film (for example, from an insulator to a conductor) at an ultra-fast speed, allowing the antenna system to adopt many configurations.

Referring generally to FIGS. 1-4, a reconfigurable antenna system 100 in accordance with the present disclosure is provided. The reconfigurable antenna system 100 may be flexible and ultra-fast reconfigurable to provide different antenna configurations. The reconfigurable antenna system 100 may include a controller 102 and a transition source 104 such as a picoprojector. The transition source 104 is configured to cause a phase transition in a layer of film 116 deposited on a surface of a substrate 114 of the antenna 108. The film 116 may include vanadium dioxide and is configured to transition from a first phase to a second phase in response to a stimulant 106, such as laser light. The controller 102 is in communication with the transition source 104 and is configured to change the configuration of the antenna 108 by providing the transition source 104 to the film 116 in a predetermined pattern. The configuration of the antenna 108 may include at least one of a radiation polarization, an operating frequency bandwidth, a radiation pattern, an antenna structure or architecture of the antenna 108, any of which may be selectively varied by the system 100 to provide a variety of antenna configurations.

The film 116 may include at least two phases, and is configured to phase shift from the first phase to the second phase in response to the stimulant 106. The phases may include a conductor, a semiconductor and an insulator. In one embodiment, the first phase includes a semiconductor and the second phase includes a conductor. Similarly, the film may phase shift from being in a conductive phase to a non-conductive (insulator) phase. The ability of the reconfigurable antenna system 100 to phase shift, and specifically to shift from a conductive state to a non-conductive (transparent) state may provide the advantage of making the reconfigurable antenna system 100 essentially invisible and undetectable. This may help the reconfigurable antenna system 100 in stealth operations where the avoidance of detection of the reconfigurable antenna system 100 is desired.

The film 116 used in the reconfigurable antenna system 100 may be configured to transition from the first phase to the second phase in response to the stimulant at an ultra-fast speed. The ultra-fast switching provided by the film 116 helps to facilitate the reconfigurability of the reconfigurable antenna system 100. In one example, the film 116 may switch from a transparent (non-conductive) state to a reflective (conductive) state in less than 100 femtoseconds (one tenth of one trillionth of a second). Similarly, the film 116 may switch from a conductive state to a transparent state in less than 100 femtoseconds (one tenth of one trillionth of a second).

The film 116 used in the reconfigurable antenna system 100 may include a combination of one or more substances. Similarly, the film 116 may include multiple layers of film 116 in one embodiment. The film 116 may also be layered with other substances, either between the film 116 and the substrate 114 or on a top surface of the film 116.

The film 116 used in the reconfigurable antenna system 100 may be vanadium dioxide in one embodiment. The film 116 may also include mixtures including other substances along with the vanadium dioxide. The use of a vanadium dioxide film may be advantageous in that it can phase transition at a rate of less than 100 femtoseconds (one tenth of one trillionth of a second). This is generally much faster than other substances. Vanadium dioxide may also be capable of phase transitioning without requiring a change in temperature. For example, vanadium dioxide may be able to phase transition from a stimulus of coherent radiation such as 532 nm laser light without requiring a change in temperature.

The phase transition may be initiated by a variety of stimulants 106. In one embodiment, the stimulant includes coherent laser light of sufficient power to cause the phase transition in the film 116. This may include optically modulated laser light in one embodiment, such as 532 nm laser light. This is suitable for phase transitioning vanadium dioxide film in one example.

The stimulant 106 may also include other stimulants to correspond to different film types. For example, the stimulant 106 may include a coherent laser light stimulant, an electrical field stimulant, a magnetic field stimulant, a gas stimulant, a chemical stimulant, a pressure stimulant, or a temperature stimulant. The type of stimulant 106 selected may depend on the type of film 116 and the properties of the film 116. For example, vanadium dioxide film is known to phase shift in response to 532 nm coherent laser light. The stimulant 106 selected may be based on the film 116 and is used to cause the film 116 to phase transition.

The transition source 104 is in communication with the controller 102 and is configured to provide the stimulant 106 to the film 116 to cause the film 116 to transition from one phase to another phase. The transition source 104 will vary depending on the type of stimulant 106. In one example, the transition source 104 includes an optical engine such as the type of optical engine used in a cell phone picoprojector. The optical engine is configured to provide laser 532 nm light to the film 116. The optical engine includes a LDLP (laser digital light picoprojector) composed of a microchip set and is used to project the predetermined antenna image onto the film. Within the microchip set is a DMD (digital micromirror device) to spatially modulate the laser light 106 and produce a computer generated antenna image in the film 116. The microchip set also directs the precise focusing of the laser light 106 stimulant at the film layer in the two-dimensional implementation shown in FIG. 2 or at more than one film layer in the three-dimensional implementation shown in FIG. 3.

In embodiments where the stimulant 106 includes an optical engine system, the optical engine system may include electronics, a laser light source and scanning mirrors. The electronics system of the optical engine turns the predetermined antenna image generated by the controller 102 into an electronic signal that drives the laser light source intensity and steers the mirrors to project the predetermined antenna image generated by the controller 102 pixel-by-pixel onto the film 116. This entire optical engine system may be compacted into a microchip in one embodiment.

The reconfigurable antenna system 100 may also include a controller 102 in communication with the transition source 104. The controller 102 is configured to generate an antenna image which is provided to the transition source 104. The controller 102 may include any suitable controller, and includes a microcontroller in one embodiment. The transition source 104 may turn the microcontroller generated antenna image into an electronic signal that provides the stimulant 106 to the film 116 to cause the phase shift in the film according to a predetermined antenna image. The controller 102 and the transition source 104 may be implemented jointly into a single element of the reconfigurable antenna system 100, or may be separate elements.

The reconfigurable antenna system 100 may be used to provide a wide range of antenna configurations, including antennas having wide-band or multi-band capability, and antennas having a wide variation in radiation patterns and polarity. For example, the reconfigurable antenna system 100 may be used to generate an antenna array, as shown in FIG. 1A. The array antenna may include a two-dimensional microstrip patch antenna array in one example or a three-dimensional stacked microstrip patch or Yagi-Uda antenna array in another example. In the antenna array shown in FIG. 1A, the antenna 108 has been configured to include conductive areas 110 which are in a conductive phase and non-conductive areas 112 which are in a semiconductive or insulator phase. Portions of the film 116 are selectively transitioned into a conductive phase according to the predetermined antenna image provided to the transition source 104 by the controller 102.

Figure 1B:
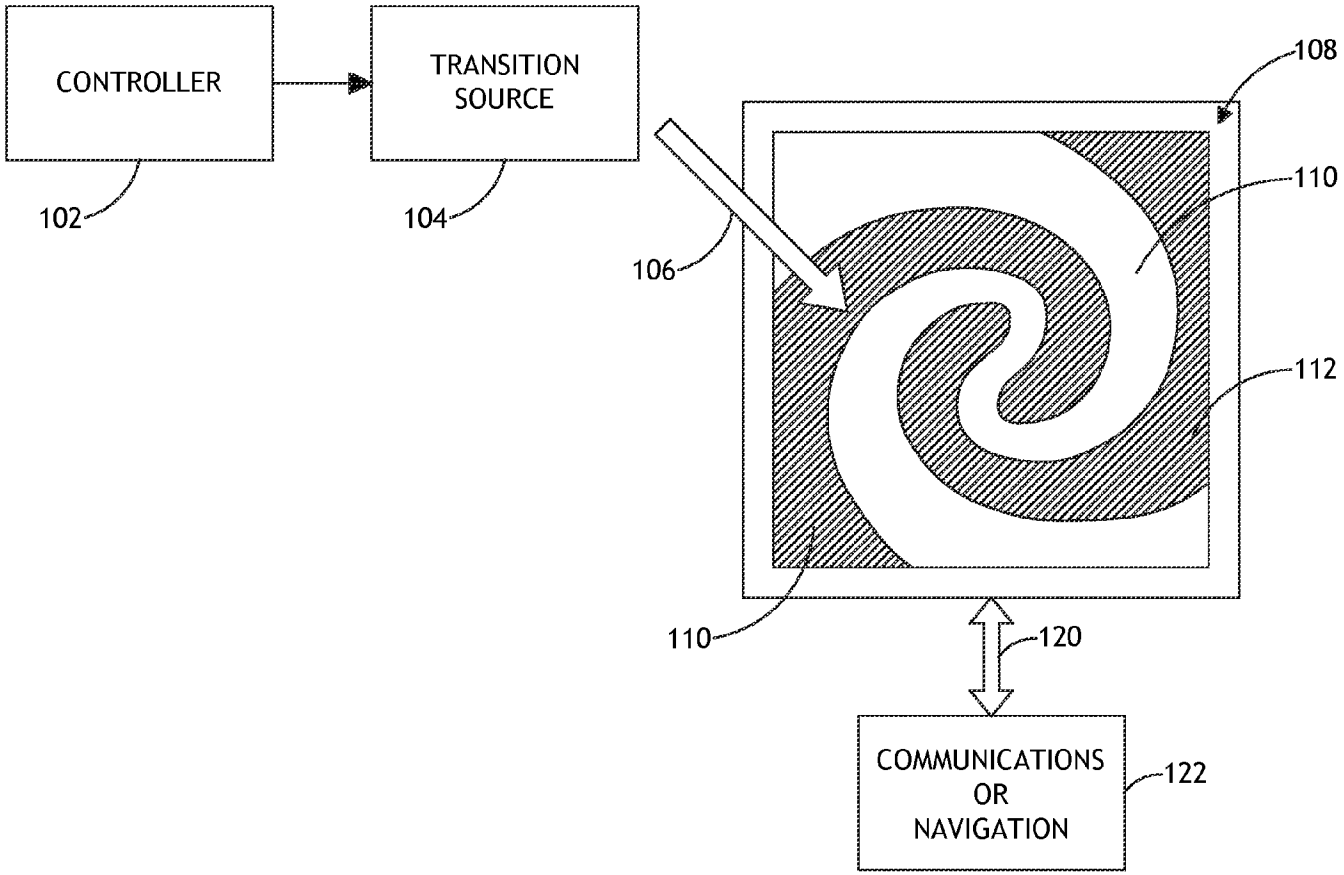
FIG. 1B is a diagram of a reconfigurable antenna system.

In another example, the reconfigurable antenna system 100 may also be used to provide a circularly polarized frequency-independent spiral antenna configuration as shown in FIG. 1B. In the example shown in FIG. 1B, the antenna 108 is divided into a conductive area 110 which is in conductive phase and a non-conductive area 112 which is in a semiconductive or insulator phase.

The reconfigurable antenna system 100 of the present disclosure may be configured to switch from the array antenna configuration depicted in FIG. 1A to the spiral antenna configuration depicted in FIG. 1B in an ultra-fast timeframe. In one example, the reconfigurable antenna system may switch configurations in less than 100 femtoseconds. The reconfigurable antenna system 100 may also be configured to switch from the spiral antenna configuration to the array configuration in an ultra-fast timeframe. Similarly, the reconfigurable antenna system 100 may be configured to switch from a conductive mode (with a configuration such as the spiral antenna configuration or the array antenna configuration, or some other configuration) into a non-conductive mode (such as semiconductor phase or insulator phase) in an ultra-fast timeframe. The reconfigurable antenna system's capability to switch quickly into a non-conductive mode may be useful in stealth operations where the reconfigurable antenna system 100 needs to avoid detection. Those skilled in the art will appreciate that the configurations described herein are merely exemplary and are not intended to be limiting. The number and type of configurations the reconfigurable antenna system 100 is able to provide is not limited to the examples described in this disclosure.

The reconfigurable antenna system 100 may also include a radio frequency feed point, which may be located on the substrate 114. A conductive area 110 of the antenna 108 may register to and form a connection with the radio frequency feed point in order to facilitate communication with, for example, communications or navigation equipment 122. The connection between the antenna 108 and the communications or navigation equipment 122 may include a radio frequency coaxial cable 120 that connects to the radio frequency feed point in one embodiment.

The reconfigurable antenna system 100 may also include a substrate 114 where the film 116 may be deposited. The substrate 114 may serve as a foundation for the antenna 108 and more specifically the film 116. The substrate 114 is generally a semiconductor or an insulator. The substrate 114 may be formed of a variety of materials, including a ceramic, epoxy, fiber glass, alumina (sapphire), or mixtures or layers thereof. The substrate may also include a conductive layer metal ground plane or a magnetic ground plane layer or a resistive or absorptive layer in accord with a specific antenna design, architecture or application.

The reconfigurable antenna system 100 is used to configure the antenna 108 in the predetermined antenna image or configuration, and also to reconfigure the antenna 108 into a different antenna image or switch to a non-conductive mode at an ultra-fast speed. The radiation pattern, operating bandwidth, and radiation polarity of the antenna 108 may vary. In the examples provided in this disclosure, the antenna 108 may implement a two- or three-dimensional array of antenna elements or a spiral antenna. Other antenna configurations may include monopole antennas, dipole antennas, folded dipole antennas, cross-dipole antennas, beam steering arrays of monopole antennas, dipole antennas, crossed-dipole antennas, linear and circularly polarized microstrip antennas, slot antennas, cavity backed slot antennas, modulated arm width, hybrid, circular or square spiral antennas, fractal antennas, genetic algorithm antennas, log periodic or Yagi Uda antennas, sinuous antennas, tapered slot Vivaldi antennas, helix antennas, loop antennas, genetic algorithm antennas, and planar inverted-F antennas.

Figure 3:
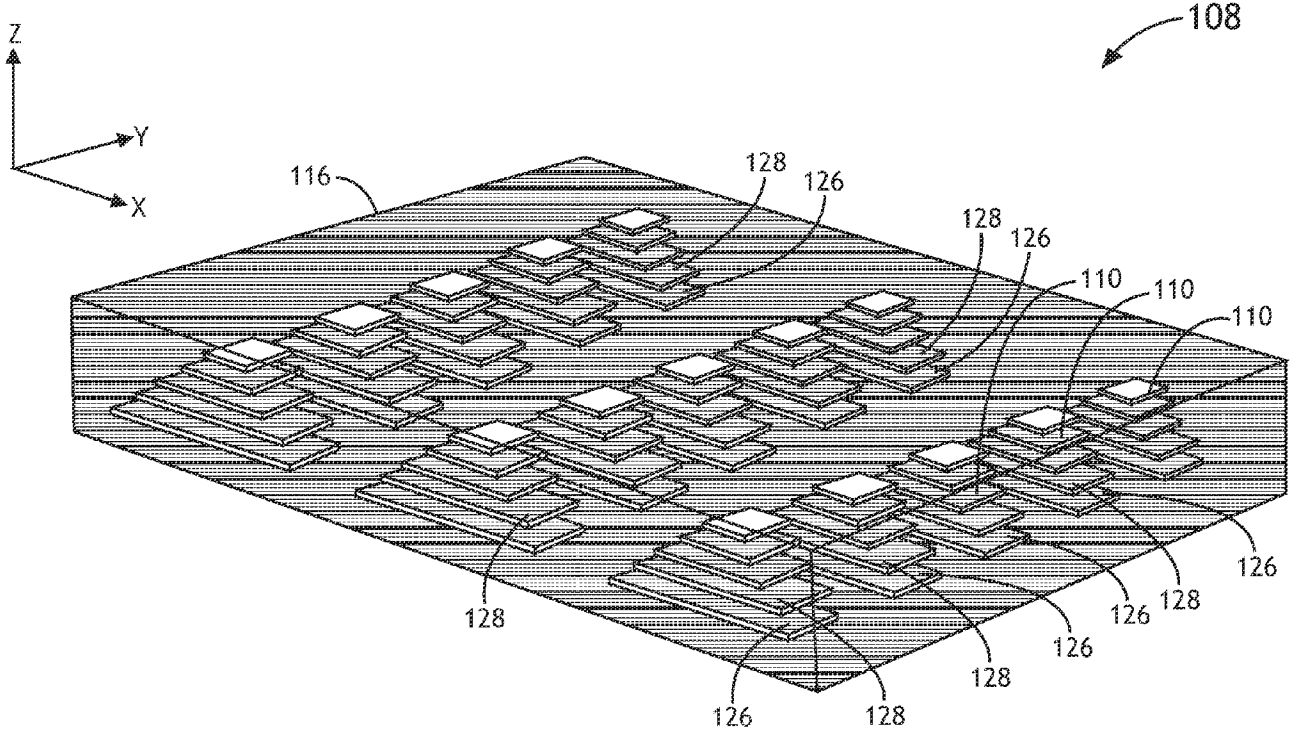
FIG. 3 is a diagram of a three dimensional implementation of a reconfigurable antenna system.
Figure 4:
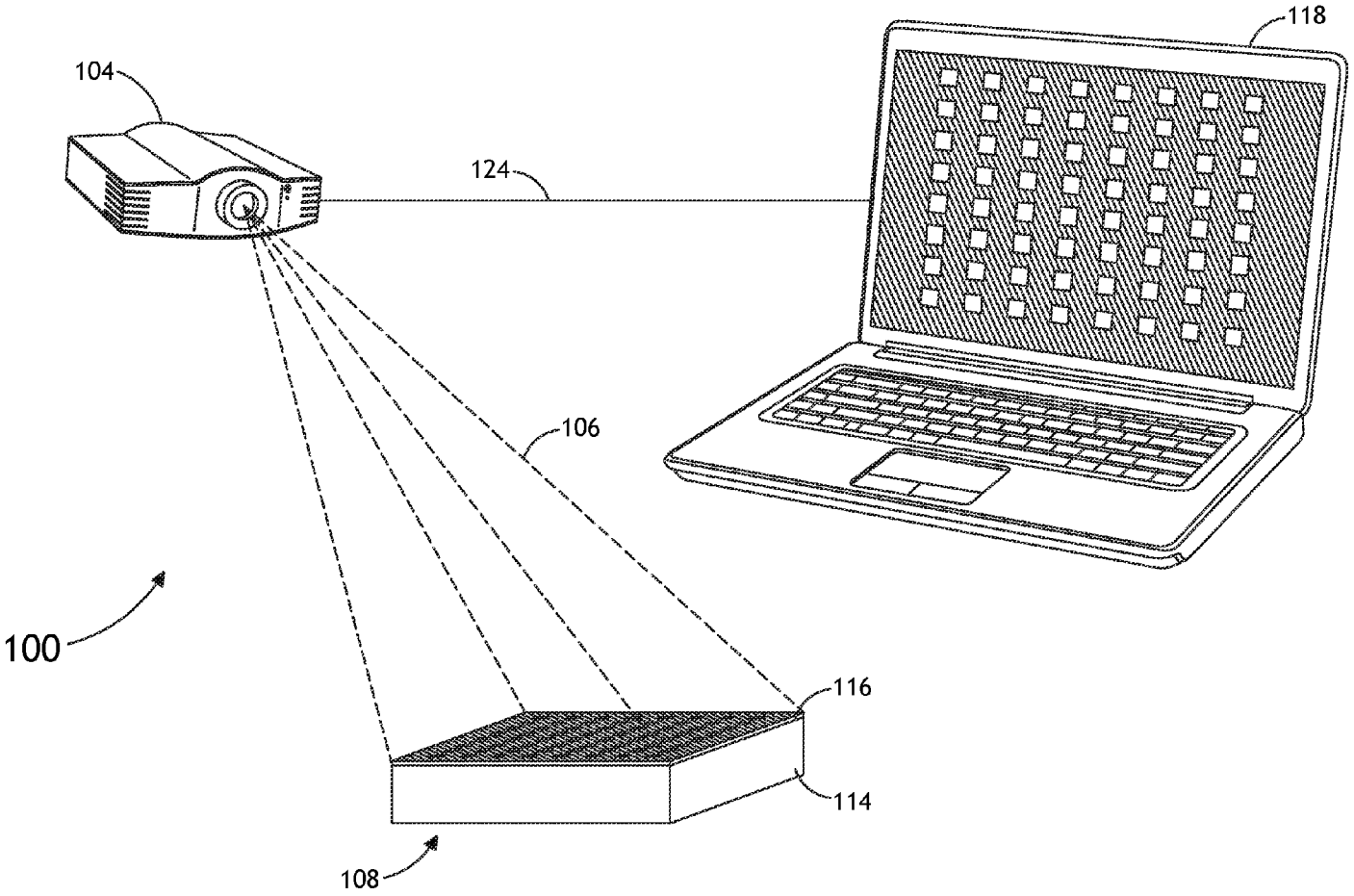
FIG. 4 is a diagram of a reconfigurable antenna system.

The reconfigurable antenna system 100 may also be capable of providing an antenna having a three dimensional configuration as shown in FIG. 3 of the present disclosure. In the three dimensional configuration, the transition source 104 may phase transition selected portions of the film into a transmissive state along any of the x, y, or z axes shown in FIG. 3. The reconfigurable antenna system 100 may include more than one layer of the film 116 in one embodiment. In another embodiment, the film 116 may be one layer but thick enough that selected portions of the film 116 may be phase transitioned along the z-axis.

In the example shown in FIG. 3, the antenna 108 includes conductive portions 110 in a layered configuration. The layered configuration may be achieved by precisely focusing the laser light in the three-dimensional implementation using the laser digital light picoprojector and digital micromirror device optical engine. The antenna 108 may include multiple antenna arrays comprised of conductive portions 110. The conductive portions 110 may be arranged in a stacked configuration. For example, a first antenna array 126 may be located in a first portion of the film 116, with a second antenna array 128 stacked above the first antenna array 126. Additional antenna arrays may be further stacked in layers above the first antenna array 126 and the second antenna array 128.

The multiple array antennas arranged in a stacked configuration shown in FIG. 3 may operate as a single antenna system comprised of the multiple arrays in one embodiment. Similarly, each antenna array shown in FIG. 3 may operate as a separate antenna system in another embodiment. For example, the film 116 may implement the first antenna array 126 may operate as an independent antenna system from the second antenna array 128.

The multiple array antennas arranged in a stacked configuration shown in the three dimensional antenna array system of FIG. 3 may be implemented simultaneously using a plurality of picoprojectors, or at different times using a single picoprojector. Similarly, the system of FIG. 3 may be continuously reconfigured.

The three dimensional antenna array system shown in FIG. 3 includes a single layer of the film 116. In other embodiments of the invention, the film 116 may include multiple layers. Each layer may be composed of the same film 116 type, or multiple layers incorporating different film types may be included. Each layer of film may include a separate antenna array system in one embodiment.

The antenna image or configuration adopted by the antenna 108 may be generated by the controller 102, which may include a microcontroller. The microcontroller may be implemented on a computer system 118 and then communicated to the transition source 104 to generate the image or configuration on the antenna 108. An example of such an implementation is provided in FIG. 4. The computer system 118 may be in communication with the transition source 104 via a wireless bus 124. The computer system 118 may implement software that is used to compute and generate the desired antenna configuration. The configuration of the antenna 108 may include different polarizations, bandwidths, frequencies, and radiation patterns which are selectively varied by varying the antenna image. The configuration of the antenna 108, including the antenna's polarization, frequency, and radiation pattern may be changed by changing the antenna image implemented by the reconfigurable antenna system 100. The image or configuration generated by the computer system 118 may depend on the circumstances, such as the desired antenna type and the type of communication system.

The image or configuration adopted by the antenna 108 may be generated via a static process where each configuration is generated, communicated, and implemented on the reconfigurable antenna system 100 one at a time. The image or configuration adopted by the antenna 108 may also be generated via a continuous process where the antenna 108 undergoes continuous reconfiguration and may generate a new configuration while an existing configuration is in the process of being incorporated. The ability of the film 116 to phase transition at an ultra-fast speed may help to facilitate the continuous imaging process.

The flexibility of configurations that the transition source 104 may provide to the antenna 108 results in a wide range of variability to the radiator image ultimately projected by the antenna 108. The flexibility in configurations may provide advantages to the reconfigurable antenna system 100 by making it suitable for applications requiring frequency hopping and federated antenna reduction.

Figure 2:
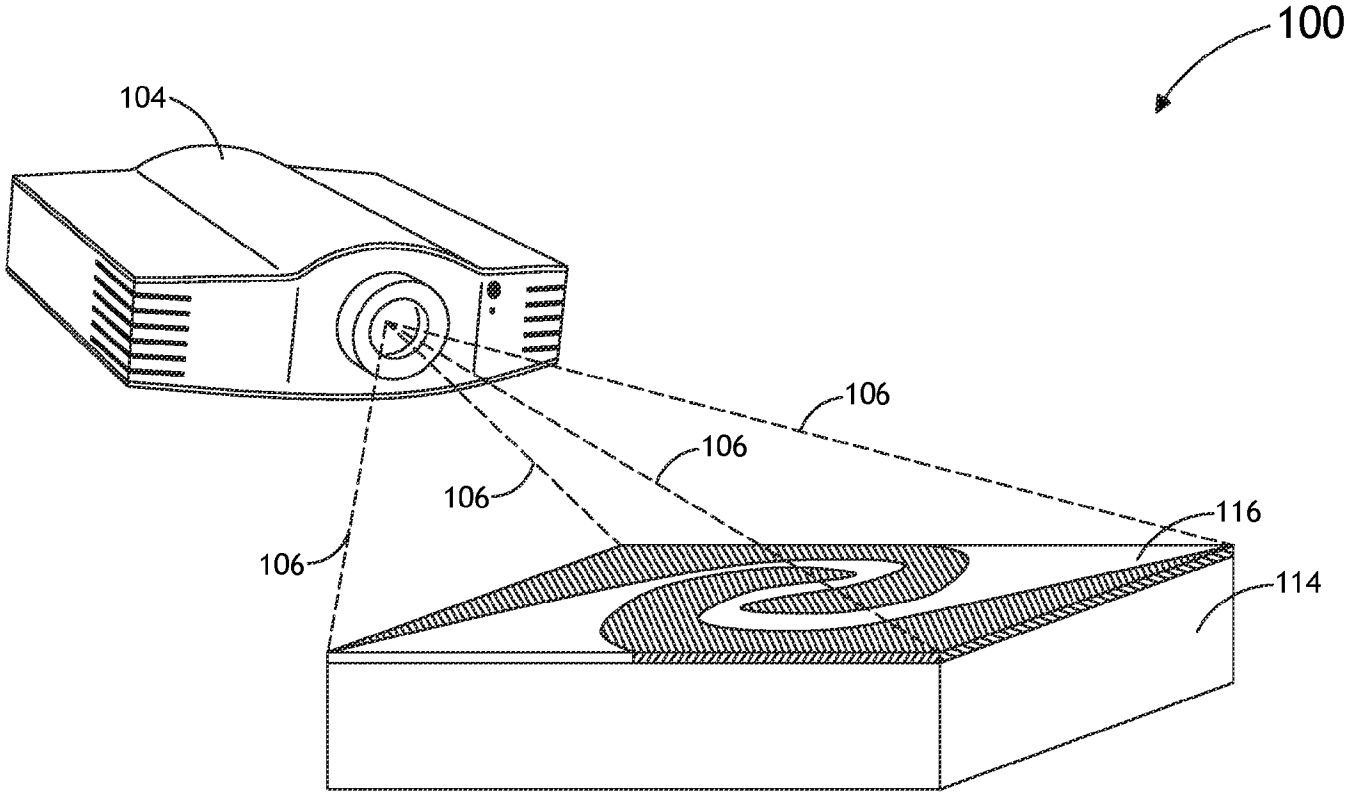
FIG. 2 is a diagram of a film deposited on a substrate of an antenna.

An example implementation of the reconfigurable antenna system 100 is shown in FIG. 2. The reconfigurable antenna system 100 includes a computer simulated antenna configuration projected onto a vanadium dioxide film to produce a real antenna radiator. The reconfigurable antenna system 100 includes a vanadium dioxide film 116 deposited on a surface of a substrate 114. The vanadium dioxide film 116 is configured to phase transition according to the parameters of the computer simulated antenna image. The vanadium dioxide film 116 phase transitions at an ultra-fast speed in response to laser light 106 projected by a picoprojector 104. The reconfigurable antenna system 100 also includes a microcontroller (not shown in FIG. 1), which is in communication with the picoprojector 104. The microcontroller is configured to generate the predetermined antenna image and to change the configuration of the antenna by providing the picoprojector 104 to at least a portion of the vanadium dioxide film 116 in a predetermined antenna image. In the embodiment shown in FIG. 2, the predetermined antenna image includes a frequency-independent spiral antenna configuration. The frequency-independent spiral antenna configuration shown in FIG. 2 is merely exemplary and the reconfigurable antenna system 100 may be ultra-fast reconfigured into a variety of antenna configurations. For instance, the radiation polarization, operating frequency, and radiation pattern of the reconfigurable antenna system 100 may all be selectively controlled and varied as desired.

Figure 5:
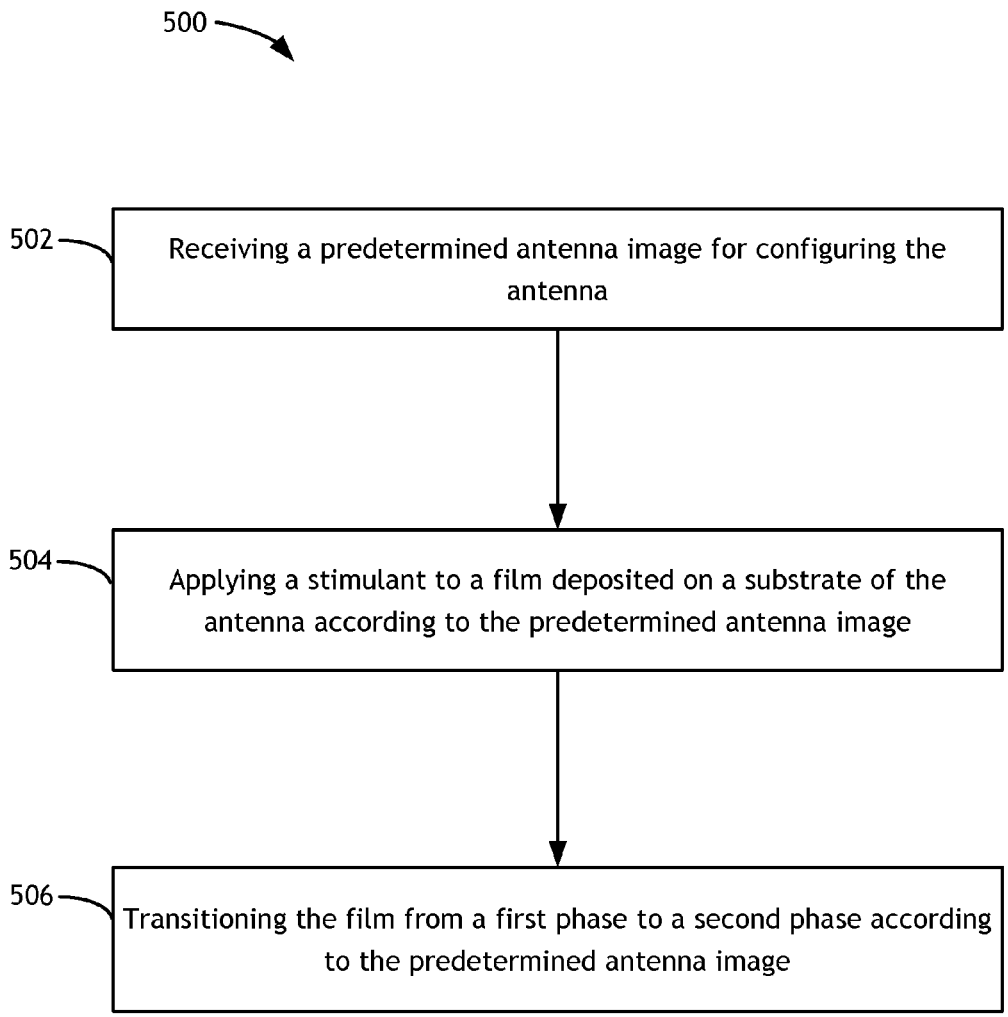
FIG. 5 is a flow chart of a method for configuring an antenna.

The present disclosure is also directed to a method 500 for configuring an antenna, as shown in FIG. 5. The method 500 may include the step of receiving a predetermined antenna image for configuring the antenna 502. The method 500 also includes the step of applying a stimulant to a film deposited on a substrate of the antenna according to the predetermined antenna image 504. The method 500 also includes the step of transitioning the film from a first phase to a second phase according to the predetermined antenna image 506. The method 500 may be used to change a configuration of the antenna, including the antenna's polarization, frequency, and radiation pattern, and may also be used to configure and reconfigure the antenna into any desired configuration.

The method 500 may also include additional steps. For example, the method 500 may also include the step of receiving a second predetermined antenna image for configuring the antenna into a second configuration. The antenna may change from the first configuration to the second configuration at an ultra-fast speed in one embodiment. Similarly, the method 500 may include the step of transitioning the film from a conductive phase to a non-conductive (semiconductor or insulator) phase. This step may also be completed at an ultra-fast speed. For example, the transition may occur at a rate of less than 100 femtoseconds. The step of rapidly transitioning the antenna from a conductive phase to a non-conductive phase may be useful in applications requiring the antenna to adopt a stealth mode to minimize the risk of detection.

The stimulant used in the method 500 may include any one of a coherent laser light stimulant, an electrical field stimulant, a magnetic field stimulant, a gas stimulant, a chemical stimulant, a pressure stimulant, or a temperature stimulant.

The film used in the method 500 may include at least two phases. The phases may include a conductor, semiconductor, or insulator phase. In one embodiment, the film includes vanadium dioxide, and the stimulant includes laser light.

The systems and methods of the present disclosure may provide several advantages. First, the reconfigurable antenna system of the present disclosure is capable of adopting any configuration and is not limited to a particular geometry or implementation. The reconfigurable antenna system is flexible and capable of adopting different configurations, including wide-band or multi-band capability, and variation in radiation pattern and polarity, thus providing variability to the antenna's radiator image. Second, the reconfigurable antenna system of the present disclosure is capable of switching from a conductive to a non-conductive state at an ultra-fast speed. This may make the reconfigurable antenna system suitable for stealth operations where the reconfigurable antenna system needs to avoid detection. Third, the reconfigurable antenna system of the present disclosure does not require an integrated antenna control circuitry and voltages, such as those used to switch MEMS cells or PIN diodes to effect the reconfiguration. This means that the reconfigurable antenna system of the present disclosure may be implemented in a simple, low-cost, compact structure. It may be necessary to use several types of MEMS or printed circuit board antennas would be required to approximate the diversity of the reconfigurable antenna system of the present disclosure.

It is understood that the present disclosure is not limited to any underlying implementing technology. The present disclosure may be implemented utilizing any combination of software and hardware technology. The present disclosure may be implemented using a variety of technologies without departing from the scope and spirit of the disclosure or without sacrificing all of its material advantages.

In the present disclosure, the methods disclosed may be implemented as sets of instructions or software readable by a device. Further, it is understood that the specific order or hierarchy of steps in the methods disclosed are examples of exemplary approaches. Based upon design preferences, it is understood that the specific order or hierarchy of steps in the method can be rearranged while remaining within the disclosed subject matter. The accompanying method claims present elements of the various steps in a sample order, and are not necessarily meant to be limited to the specific order or hierarchy presented.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

What is claimed is:

1. A reconfigurable antenna system, comprising:

a substrate;

a film deposited on a surface of the substrate, the film configured to transition from a first phase to a second phase in response to a stimulant;

a transition source, the transition source configured to provide the stimulant to the film to transition at least a portion of the film from the first phase to the second phase; and a controller, the controller in communication with the transition source, the controller configured to control the transition source to provide stimulant to at least a portion of the film according to a predetermined antenna image.

2. The reconfigurable antenna system as claimed in claim 1, wherein the stimulant includes at least one of a coherent laser light stimulant, an electrical field stimulant, a magnetic field stimulant, a gas stimulant, a chemical stimulant, a pressure stimulant, or a temperature stimulant.

3. The reconfigurable antenna system as claimed in claim 1, wherein the film includes at least two phases.

4. The reconfigurable antenna system as claimed in claim 3, wherein the at least two phases includes at least two of a conductor, a semiconductor or an insulator.

5. The reconfigurable antenna system as claimed in claim 1, wherein the first phase includes a semiconductor and the second phase includes a conductor.

6. The reconfigurable antenna system as claimed in claim 1, wherein the film comprises vanadium dioxide.

7. The reconfigurable antenna system as claimed in claim 1, wherein the transition source comprises a projection system and the stimulant comprises laser light.

8. The reconfigurable antenna system as claimed in claim 1, wherein the film transitions from the first phase to the second phase in response to the stimulant in less than 100 femtoseconds.

9. The reconfigurable antenna system as claimed in claim 1, wherein the first phase includes a conductive phase and the second phase includes an insulator and the film transitions from the first phase to the second phase in less than 100 femtoseconds.

10. A method for configuring an antenna, the method comprising:

receiving a predetermined antenna image for configuring the antenna;

applying a stimulant to a film deposited on a substrate of the antenna according to the predetermined antenna image; and transitioning the film from a first phase to a second phase according to the predetermined antenna image, wherein the film includes at least two phases, wherein the at least two phases includes at least two of a conductor, a semiconductor or an insulator.

11. The method as claimed in claim 10, wherein the stimulant includes at least one of a coherent laser light stimulant, an electrical field stimulant, a magnetic field stimulant, a gas stimulant, a chemical stimulant, a pressure stimulant, or a temperature stimulant.

12. The method as claimed in claim 10, wherein the first phase includes a semiconductor and the second phase includes a conductor.

13. The method as claimed in claim 10, wherein the film comprises vanadium dioxide.

14. The method as claimed in claim 10, wherein the applying a stimulant to a film deposited on a substrate of the antenna comprises using a picoprojection system to apply laser light to the film.

15. The method as claimed in claim 10, wherein the first phase includes a conductive phase and the second phase includes an insulator and the film transitions from the first phase to the second phase in less than 100 femtoseconds.

16. The method as claimed in claim 10, wherein the transitioning the film from a first phase to a second phase according to the predetermined antenna image occurs in less than 100 femtoseconds.

17. The method as claimed in claim 10, further comprising:

receiving a second predetermined antenna image for configuring the antenna into a second configuration.

18. A method for configuring an antenna, the method comprising:

receiving a predetermined antenna image for configuring the antenna;

applying a stimulant to a film deposited on a substrate of the antenna according to the predetermined antenna image; and transitioning the film from a first phase to a second phase according to the predetermined antenna image, wherein the applying a stimulant to a film deposited on a substrate of the antenna comprises using a picoprojection system to apply laser light to the film.

* * * * *